US012722928B2

(12) United States Patent
Christiansen

(10) Patent No.: US 12,722,928 B2
(45) Date of Patent: Sep. 1, 2026

(54) ARRANGEMENT FOR HANDLING STACKS OF SHEETS

(71) Applicant: Yaskawa Nordic AB, Torsås (SE)

(72) Inventor: Henrik Christiansen, Torsås (SE)

(73) Assignee: Yaskawa Nordic AB, Torsas (SE)

( * ) Notice: Subject to any disclaimer, the term of this patent is extended or adjusted under 35 U.S.C. 154(b) by 0 days.

(21) Appl. No.: 19/210,367

(22) Filed: May 16, 2025

(65) Prior Publication Data

US 2025/0353697 A1 Nov. 20, 2025

(30) Foreign Application Priority Data

May 17, 2024 (EP) ..... 24176784

(51) Int. Cl.
*B65H 31/30* (2006.01)

(52) U.S. Cl.
CPC ..... *B65H 31/3081* (2013.01); *B65H 31/3036* (2013.01); *B65H 2301/4224* (2013.01); *B65H 2406/113* (2013.01)

(58) Field of Classification Search
CPC ..... B65H 31/3081; B65H 31/3036; B65H 2301/4224; B65H 2406/113; B65H 31/3045; B65H 2301/42266; B65H 31/34; B65H 2301/42242; B65G 47/244; B65G 49/067; B65G 2207/06; B65G 47/525; B65G 53/20
USPC ..... 198/345.1, 379, 411; 384/12; 406/87, 406/88; 414/676, 783, 903, 789.9, 788.9
See application file for complete search history.

(56) References Cited

U.S. PATENT DOCUMENTS 3,272,568 A * 9/1966 Walther ..... F16C 32/06 384/8
3,555,865 A * 1/1971 Sebastian ..... B21J 13/00 72/448
3,717,392 A * 2/1973 Ennis ..... B23Q 1/385 384/111

(Continued)

FOREIGN PATENT DOCUMENTS

DE 3125895 A1 5/1982
DE 10121184 A1 * 10/2002 ..... B65G 51/03

(Continued)

OTHER PUBLICATIONS

Extended European Search Report, European Patent Application No. 24176784.7, dated Nov. 14, 2024.

*Primary Examiner* — Gregory W Adams
(74) *Attorney, Agent, or Firm* — Volpe Koenig

(57) ABSTRACT

There is disclosed herein an arrangement for handling one or more stacks of sheets. The arrangement comprises a support surface being provided with a plurality of openings for supplying a gas underneath said one or more stacks of sheets, a maneuver unit being moveable relative to the support surface and comprising two side clamping devices, the two side clamping devices being arranged at a distance from each other. The arrangement further comprises at least one top clamping device configured to exert a downward pressure onto said one or more stacks of sheets. The two side clamping devices and said at least one top clamping device are at least partly independently maneuverable thereby allowing the arrangement to maneuver one stack of sheets and also to maneuver a plurality of stacks of sheets arranged in a row one after the other.

15 Claims, 4 Drawing Sheets

(56) References Cited

U.S. PATENT DOCUMENTS

| | | | | | |
|---|---|---|---|---|---|
| 4,237,674 | A * | 12/1980 | Aykut | B65B 25/141 53/249 |
| 4,387,890 | A * | 6/1983 | Lampe | B65H 31/3081 414/676 |
| 5,051,058 | A * | 9/1991 | Roth | B65G 57/06 414/676 |
| 5,271,706 | A * | 12/1993 | Helbach | B65H 1/025 414/523 |
| 7,168,910 | B2 * | 1/2007 | Keller | B65B 27/08 414/792.9 |
| 7,207,250 | B2 * | 4/2007 | Lisec | B65G 49/067 83/155.1 |
| 7,637,711 | B2 * | 12/2009 | Wronski | B65H 31/06 414/793 |
| 2002/0060128 | A1 | 5/2002 | Wolf | |
| 2007/0140825 | A1 * | 6/2007 | Ruegsegger | B65H 31/30 414/794.3 |
| 2020/0338755 | A1 * | 10/2020 | Behringer | B25J 15/0616 |

FOREIGN PATENT DOCUMENTS

| | | | | |
|---|---|---|---|---|
| DE | 102009046133 | A1 * | 5/2011 | B65G 19/303 |
| DE | 102020111448 | A1 * | 10/2021 | B26D 7/02 |

* cited by examiner

ARRANGEMENT FOR HANDLING STACKS OF SHEETS

TECHNICAL FIELD

The present invention relates to an arrangement for handling one or more stacks of sheets.

BACKGROUND

Digital printing of multiple copies of the same image on a single large sheet offers a cost-effective and rapid means for mass production of images. The image is replicated in adjacent positions across the sheet before being divided into individual copies. This method has gained popularity alongside the increasing demand for numerous copies within our global society.

Typically, a large-scale cutting machine is employed to slice through stacks of these large sheets, transforming them into separate stacks of individual copies. This process often involves personnel or robotic assistance, with the stack being translated and rotated with precision to align with the cutting machine. Once the initial cut is made, the stack is repositioned for subsequent cuts along different lines. Incorporating robotics into this workflow enhances efficiency, thereby streamlining the production process.

However, the existing arrangement for cutting these large sheets are too complex and not efficient enough. Complex arrangements of tables and robot arms with grippers to grip the stacks of sheets are used. The grippers of the robots are not adaptable enough and does not provide an efficient enough way of handling the stacks. Therefore, improved and more efficient arrangements for handling stacks of sheets are needed.

SUMMARY

It is an object of the invention to provide a solution that addresses at least some of the design criteria described above, namely, to provide more flexible yet efficient arrangements for handling one or more stacks of sheets. Preferably, the arrangement is more efficient than existing systems for handling stacks of sheets, further reduces the labour costs and increases the speed of handling and cutting stacks of sheets. Thereby, further improving the cost-efficiency of arrangement for handling stacks of sheets. This has in accordance with a first aspect been accomplished by an arrangement for handling one or more stacks of sheets, which arrangement comprises;

- a support surface being arranged to support said one or more stacks of sheets and being provided with a plurality of openings for supplying a gas underneath said one or more stacks of sheets,
- a maneuver unit being moveable relative to the support surface and comprising two side clamping devices, the two side clamping devices being arranged at a distance from each other along a longitudinal direction and being configured to interact with two opposing sides of said one or more stacks of sheets, and
- at least one top clamping device configured to exert a downward pressure onto said one or more stacks of sheets,
- wherein the two side clamping devices and said at least one top clamping device are at least partly independently maneuverable thereby allowing the arrangement to maneuver one stack of sheets and also to maneuver a plurality of stacks of sheets arranged in a row one after the other along the longitudinal direction between the two side clamping devices.

The provided arrangement allows for a flexible handling of stacks of sheets. A flexible handling of stack of sheets is of great importance in many industries, such as printing and packaging, manufacturing, and textile. Material of the sheets may be for example paper, wood, fabric, non-woven or metal. The preferred embodiment disclosed herein is especially suitable for stacks of sheets of paper. By automating the handling of the stacks of sheets, less personnel are needed, and no personnel has to directly handle the stacks of sheets. This improves the safety of the personnel and also the cost-efficiency for the site owner. As an example, when the stacks of sheets are handled and positioned in a cutting machine, it is much safer if personnel do not directly operate the stack of sheets at the cutting machine and instead are monitoring an arrangement that handles the stack of sheets.

With the provided arrangement it is possible to handle one stack of sheets at a time, but also to handle a plurality of stacks of sheets at the same time. Generally, multiple copies of the same image or product is produced on each sheet, the images or products being placed adjacent to each other. These stacks of sheets with the images are aligned in a cutting machine and then separated from each other by the cutting machine. In other words, the arrangement starts with one stack of sheets and after cutting the stack of sheets there will be a plurality of stacks of sheets. For example, there may be three rows and three columns of images. In this case, the arrangement may e.g., first position each row for cutting and then each column for cutting, such that in the end there will be nine separate stacks of sheets. The two side clamping devices have a great functionality when there is one stack of sheets as the stack of sheets may be clamped between the two side clamping devices. Thus, the stack of sheets can easily be maneuvered in different directions on the support surface.

Moreover, by the arrangement further having at least one top clamping device, the arrangement may handle two stacks of sheets adjacent to each other. If only the side clamping devices are used when we have two stacks of sheets adjacent to each other, the side clamping devices will have a tendency to push these stacks of sheets together and the two stacks of sheets may be mixed or any other type of unorder between the stacks of sheets may occur. The top clamping device may be used to put pressure on for example two stacks of sheets such that the two stacks of sheets are not able to move toward each other, thereby mixture of the two stacks of sheets can be avoided. The top clamping device can extend over both of the stacks of sheets such that both stacks of sheets are pressed by one top clamping device. It should be noted that one top clamping device could be used for more than two stacks of sheets and also for one stack of sheets as well.

Further, the at least one top clamping device may also be used to provide a downward pressure on the one or more stacks of sheets during a cutting process. By providing a downward pressure on the one or more stacks of sheets a more precise cut may be achieved as the sheets are not able to move during the cut.

The support surface is provided with said plurality of opening to allow a gas to be supplied underneath the one or more stacks of sheets. The gas is a pressurized gas. The gas is forced out from the openings to provide a lifting force to the sheets lying on the support surface. This improves the maneuverability of the stack of sheets when lying on the support surface. For example, when the two side clamping devices are clamping a stack of sheets, the gas will provide a lifting force under the stack of sheets such that the stack of sheets may glide more smoothly on the support surface. Generally, air is used as the gas for this type of applications. However, other gases may also be used. Especially for sensitive manufacturing processes, it may be conceivable to use an inert gas.

The side clamping devices and the at least one top clamping device allows for using different combinations of clamping set-ups to maneuver the stack of sheets. By these being at least partly independently maneuverable, it allows for different ways of freely operating one or more of the side clamping devices and the top clamping device, while one or more of the others is/are not moved. For example, by moving only one of the side clamping devices, the stack of sheets can be pushed over the support surface. By using both of the side clamping devices, the stack of sheets can be maneuvered around on the table and be rotated. Also, the top clamping device can alone be used to clamp the stack of sheets or stacks of sheets to move and rotate these. Further, a combination of the side clamping devices and the top clamping device can be used to move a plurality of stacks of sheets, especially a plurality of stacks arranged in a row.

The provision of side clamping devices also allows to design the maneuver unit with a low height which allow the maneuver unit to for example extend in under upper portions of a cutting machine to reach stacks of sheets. Alternatively, this may be expressed as that the cutting machine may be designed with a comparably low clearance, which in turn makes it easier to design the cutting machine.

The term "two opposing sides of said one or more stacks of sheets" is herein intended to refer to the two opposing side of one stack of sheets when there is only one stack of sheets. In the context of a plurality of stacks of sheets, the term two opposing sides of said one or more stacks of sheets is intended to refer to the outer edges of two distinct stacks located at the respective one of the two ends of the row of stacks. For instance, if three stacks of sheets are arranged side by side in a row, a first of the two opposing sides refers to the outer side of a first end stack located at a first end of the row, and a second of the two opposing sides refers to an outer side of a second end stack located at a second end of the row. The first end stack, positioned at one end of the row, has its outer side facing away from any adjacent stack. Similarly, the second end stack located at the opposite end of the row, also has its outer side facing away from adjacent stacks. The third stack of sheets will be positioned between the first and second stack of sheets.

Said at least one top clamping device may include a vacuum functionality and may as such be referred to as vacuum top clamping devices. It may be noted that vacuum is typically used within these industries to denote an under-pressure and not total vacuum. Thus, the vacuum top clamping devices may be provided with one or more, preferably a plurality of openings, in a surface intended to face and abut the stacks of sheets via which the under-pressure may be applied to the upper sheets of the respective stack. With vacuum top clamping devices, the contact between the top clamping devices and the sheets may be improved. The sheets at the top of the stack of sheets will be affected by the vacuum of the vacuum top clamping device and will have a greater tendency to follow with the movement of the top clamping device compared to if there would only be made use of friction. This results in that the overall downward pressure from the top clamping devices can be reduced, while still achieving a similar overall effect on the stack of sheets. The use of vacuum top clamping devices may also provide an improved internal friction inside the stack. Altogether, this facilitates moving the stack of sheets on the support surface.

The at least one top clamping device may be moveable along the longitudinal direction in relation to the two side clamping devices.

Allowing the top clamping device to be moveable along the longitudinal direction provides flexibility and adaptability to the arrangement. The size of images to be cut and therefore also the dimensions of the stacks of sheets may vary. In such case it may be advantageous if the top clamping device can be moved and positioned at a desired position above the stacks of sheets. This allows the arrangement to operate with bigger variety of stack sizes.

With being moveable in the longitudinal direction is herein meant that the at least one top clamping device at least can be moved towards and away from the respective side clamping device. This allows the top clamping device to move into a position where the one or more stacks of sheets are positioned by moving the top clamping device in relation to the two side clamping devices. The respective top claiming device may be movable also in other directions, such as in a transversal direction along the support surface.

The two side clamping devices may be independently moveable at least along the longitudinal direction in relation to the maneuver unit. This allows the two side clamping devices to operate individually with the stack of sheets. By moving one of the two side clamping devices, the stack of sheets may be moved towards the other of the two side clamping devices. The gas coming through the openings of the support surface facilitates this type of movement as the stack of sheets slides more smooth on the support surface with the gas reducing the friction. This movement could also be combined with the top clamping device providing a downward pressure to keep the stack of sheets in order. The two side clamping may be movable in other directions, such as a transversal direction along the support surface.

The gas may be supplied at a pressure being balanced in relation to the downward pressure from said at least one top clamping device such that there is formed a gas cushion underneath said one or more stacks of sheets.

By forming the gas cushion underneath said one or more stacks of sheets the order in the stack of sheets may be more easily kept. With balance between the force from the gas applied through the openings and the downward pressure from the at least one top clamping device, the stack of sheets will be clamped between the gas and the at least one top clamping device. In other words, the stack of sheets could be seen as being in a hovering state above the support surface while still being pushed together by the gas and the top clamping device. The gas cushion underneath the one or more stacks of sheets will both assist with clamping the one or more stacks of sheets and facilitate the movement of the one or more stacks of sheets over the support surface, due to the hovering state of the one or more stacks of sheets.

The gas cushion is formed by supplying gas at a pressure through the openings in the support surface. By having a plurality of openings, the gas can counteract the downwards pressure from the top clamping device. This counteracting force can be adapted based on the denseness of the openings and at what pressure the gas is provided. How the openings may be distributed over the support surface depend on what type of stacks of sheets that are handled. For example, a stack of sheets of a heavier material may require a higher density of openings and that the gas is provided at a higher pressure than a stack of sheets of a lighter material. Generally, the gas used is air.

The arrangement may further comprise at least two top clamping devices.

By having at least two top clamping devices it is possible to more of less independently maneuver a greater number of stacks. The arrangement could for example be designed with one top clamping device for every two stacks of sheets or one top clamping device for each stack of sheets it is designed to handle depending on how the arrangement is intended to handle the stacks. Each additional top clamping device provides new possibilities to handle further stacks of sheets.

The at least two top clamping devices may be independently moveable along the longitudinal direction in relation to each other. This may allow the at least two top clamping devices to adapt to different sizes of stacks of sheets and to adapt to how the stacks of sheets are distributed. As an example, if there are two stacks of sheets, the two top clamping devices may be moved to apply a downward pressure on one each of the two stacks. However, if there are three one top clamping device may be used to maneuver one of the stacks and the other one may be used to hold together the two other stacks. If there are four stacks of sheets, the two top clamping devices may be moved to apply a downward pressure on two stacks each.

The maneuver unit may be translationally and rotationally moveable in a plane parallel to a plane defined by the support surface. This allows the maneuver unit to move the stacks of sheets both sideways and to rotate the stacks of sheets while the stacks of sheets are clamped. Rotationally movable in the plane refers to the device still being in the same planar orientation and rotated about an axis forming a normal to the support plane. This way the maneuver unit may be able to maneuver the stacks of sheets around on the support surface and improves the flexibility of the maneuvering of the stacks of sheets. In for example a system where the arrangement moves the stacks of sheets to a cutting machine, it may be necessary to rotate the maneuver unit to be able the position the stack of sheets correctly. Further, it allows the maneuver unit to have different angles of reaching the one or more stack of sheets.

The maneuver unit may be supported by one or more robot arms. With a robot arm the maneuvering of the maneuver unit may be improved. The robot arm is commonly used in wide industries and therefore the control methods of the robot arm is well developed. By implementing a robot arm to the maneuver unit known control methods such as through a servo motor such that the robot arm is servo controlled may be used. Further, robot arms can perform repetitive tasks with high precision and consistency, which may lead to increased productivity and efficiency.

The two side clamping devices may have planar surfaces configured to face and interact with said one or more stacks of sheets, thereby allowing the two side clamping devices to interact with stacks of sheets of different heights.

The planar surfaces provide a consistent interaction with the stack of sheets, which may maintain the integrity of the stack and prevent errors or damage during handling. Furthermore, planar surfaces are relatively simple in design and operation compared to more complex mechanisms. This simplicity can lead to easier maintenance, reduced likelihood of malfunctions, and lower overall costs.

When combining the planar surfaces with the openings providing gas from underneath, the side clamping devices are able to smoothly move the one or more stacks over the support surface. Further, with a planar surface the two side clamping devices may interact with stacks of sheets of different heights. All stack of sheets will not be of the same height as not all copies of images would be produced in the same number. Allowing a flexibility in the height of the one or more stacks of sheets provide further adaptability to the arrangement.

The present disclosure may also in short be referred to as relating to an arrangement for handling one or more stacks of sheets. The arrangement comprises a support surface being provided with a plurality of openings for supplying a gas underneath said one or more stacks of sheets, a maneuver unit being moveable relative to the support surface and comprising two side clamping devices, the two side clamping devices being arranged at a distance from each other, and at least one top clamping device configured to exert a downward pressure onto said one or more stacks of sheets. The two side clamping devices and said at least one top clamping device are at least partly independently maneuverable thereby allowing the arrangement to maneuver one stack of sheets and also to maneuver a plurality of stacks of sheets arranged in a row one after the other.

It may be noted that the use of first, second, third, fourth, fifth, etc. are mainly to be seen as labels facilitating reading and that it does not necessarily mean that there need to be all the intervening numbers of devices or portions present. However, to facilitate reading, we have consistently used the numbering first, second, third, fourth, etc., as labels, and in a sense based on an embodiment including all conceivable devices and portions.

Further scope of applicability of the present disclosure will become apparent from the detailed description given below. However, it should be understood that the detailed description and specific examples, while indicating preferred embodiments of the disclosure, are given by way of illustration and that various changes and modifications within the scope of the disclosure will become apparent to those skilled in the art from this detailed description.

BRIEF DESCRIPTION OF THE DRAWINGS

The invention will by way of example be described in more detail with reference to the appended schematic drawings, which shows a presently preferred embodiment of the invention.

DETAILED DESCRIPTION

Figure 1:
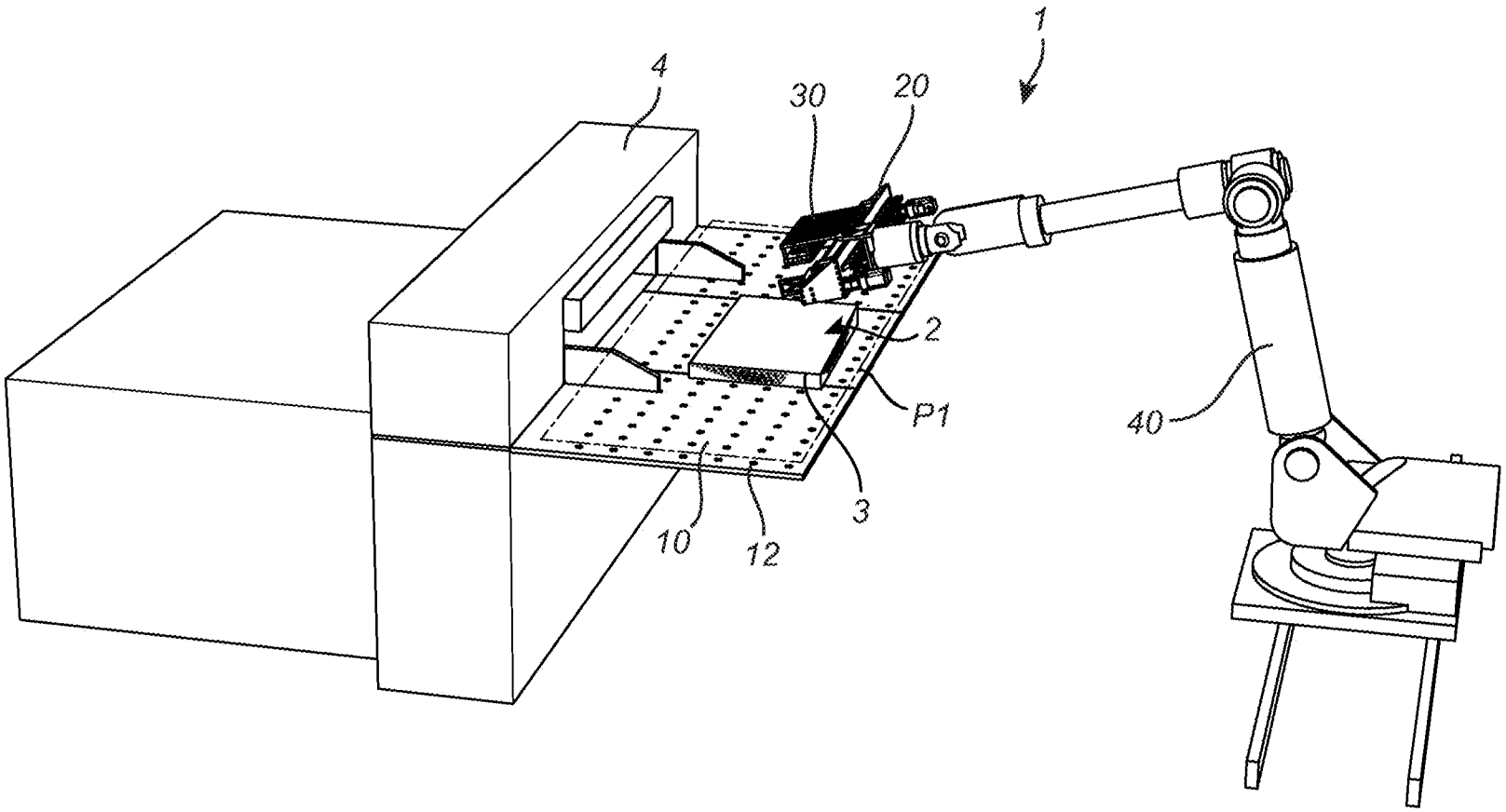
FIG. 1 discloses an overview of an arrangement for handling stacks of sheets.

FIG. 1 illustrates an arrangement 1 for handling one or more stacks 2 of sheets 3. The arrangement 1 may be located in a production line where the arrangement 1 handles one or more stacks 2 of sheets 3 to position the one or more stacks 2 of sheets 3 correctly in relation to for example a cutting machine 4. Automated handling of stacks 2 of sheets 3 are an important development for many industries such as printing, packaging, manufacturing, and textile. Material of the sheets 3 may be for example paper or metal. The arrangement 1 comprises a support surface 10 at which the stacks 2 of sheets 3 are positioned when being handled. In FIG. 1 the arrangement 1 further comprises a robot arm 40 which supports a maneuver unit 20. The maneuver unit 20 of the arrangement 1 is translationally and rotationally moveable in a plane P1 parallel to a plane defined by the support surface 10. This means that the maneuver unit 20 is moveable above the support surface 10, such that the maneuver unit 20 is able to interact with the stack 2 of sheets 3 with no or minimal contact with the support surface 10. The robot arm 40 is one possible way to provide the translationally and rotationally moveability of the maneuver unit 20. It should be noted that also a combination of more than one robot arm 40 could be used.

When combined with a cutting machine 4, the arrangement 1 is generally used to position the stack 2 of sheets 3 in the cutting machine 4 to allow the stack 2 of sheets 3 to be cut into smaller stacks 2 of sheets 3. Cutting machines 4 are known in the prior art and historically been operated by personnel which positions the stack 2 of sheets 3 in the cutting machine 4. With the arrangement 1 this kind of personnel may be replaced. When the stack 2 of sheets 3 has been cut into the correct size, the arrangement 1 can be used to move the stack 2 of sheets 3 to a conveyor belt (not shown) to be transported for further processing.

Figure 2:
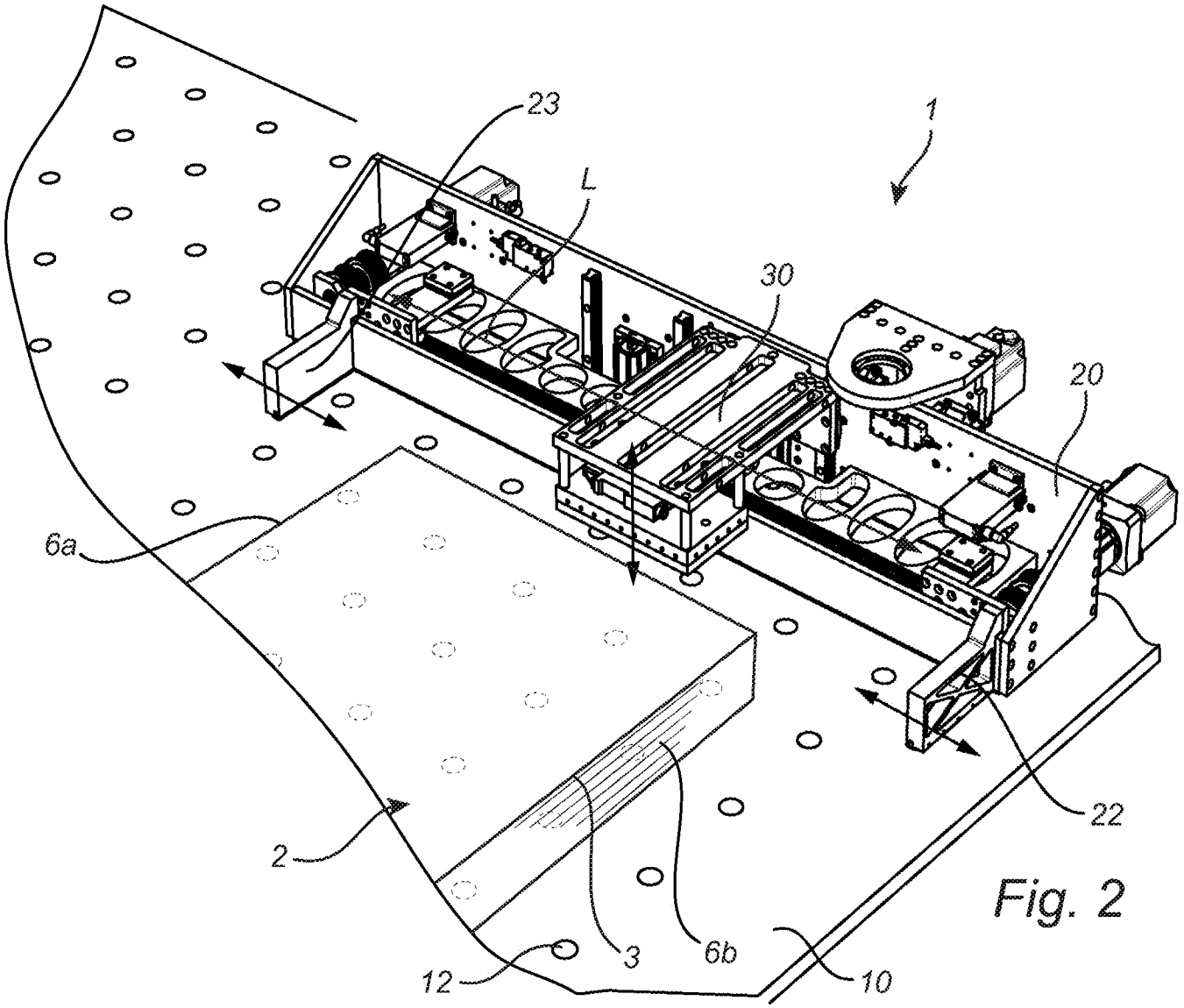
FIG. 2 discloses an example of a maneuver unit of the arrangement.
Figure 3:
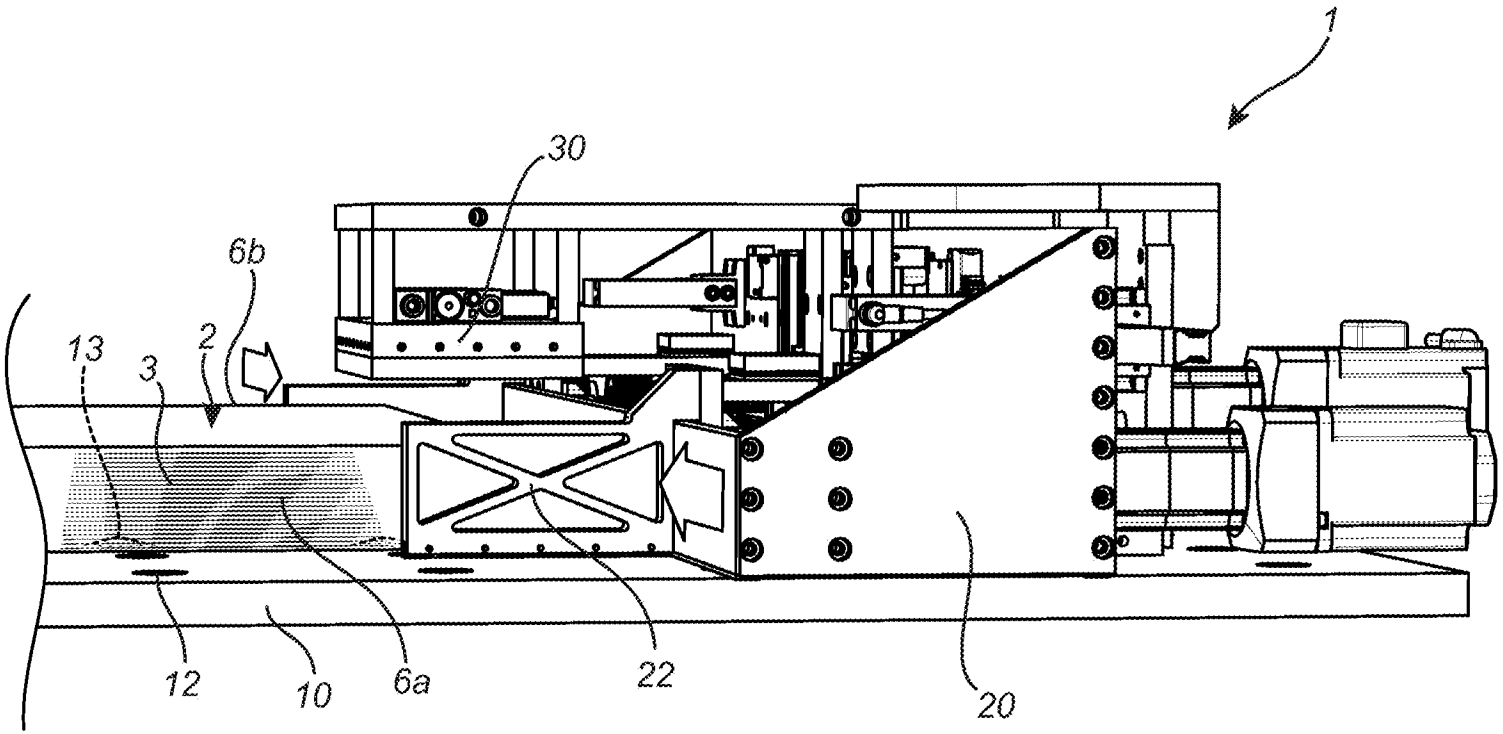
FIG. 3 discloses the arrangement interacting with one stack of sheets.
Figure 4:
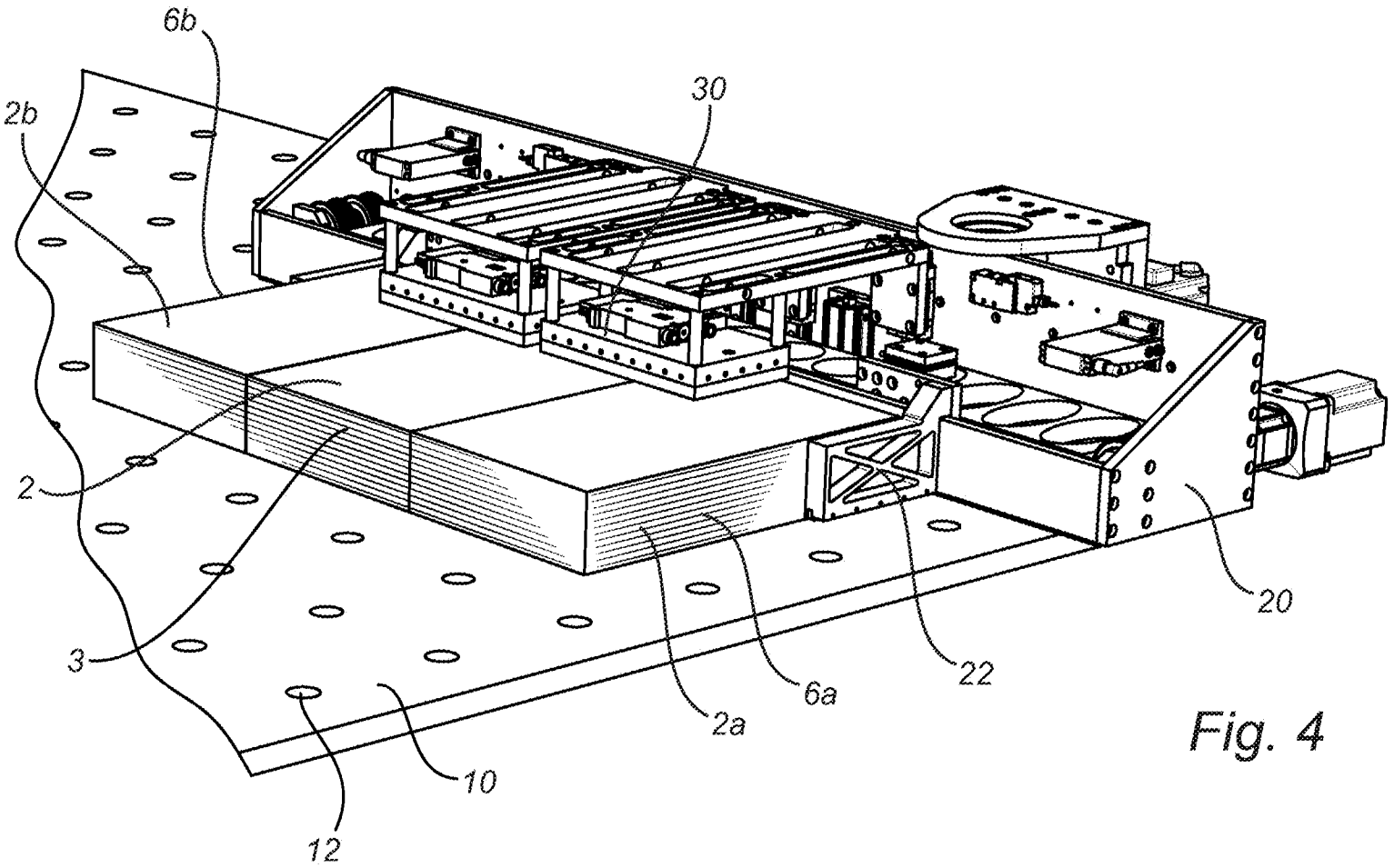
FIG. 4 discloses the arrangement interacting with a plurality of stacks of sheets.

In FIG. 2, one example of the arrangement 1 is illustrated. At this moment, the maneuver unit 20 is beginning to gather a new stack 2 of sheets 3 to be cut. Generally, multiple copies of an image or product is produced on each sheet 3, adjacent to each other. These images are aligned in a cutting machine 4 and then separated from each other by the cutting machine 4. In other words, the arrangement 1 starts with one stack 2 of sheets 3 and after the cuts there will be a plurality of stacks 2 of sheets 3. For example, in FIG. 2, there are three rows and three columns of images. In this case the arrangement 1 may first position each row for cutting and then each column for cutting, such that in the end there will be nine separate stacks 2 of sheets 3, one with each image. FIGS. 2 and 3 illustrate interaction with one stack 2 of sheets 3 and FIG. 4 illustrates interaction with three stacks 2 of sheets 3.

The stack 2 of sheets 3 are arranged on the support surface 10, which supports the stack 2 of sheets 3. The support surface 10 comprises a plurality of openings 12 which are used for supplying a gas underneath the stacks 2 of sheets 3. The gas is a pressurized gas, which generally is air. The gas is forced out from the openings to provide a lifting force to the stack 2 of sheets 3 lying on the support surface 10. This facilitates the possibility to maneuver the stack 2 of sheets 3 when lying on the support surface 10. The gas allows the stack 2 of sheets 3 to glide more smoothly over the support surface 10 when pushed or dragged.

The maneuver unit 20 is provided with two side clamping devices 22. The two side clamping devices 22 are arranged at a distance from each other along a longitudinal direction L and being configured to interact with two opposing sides 6*a*, 6*b* of said one or more stacks 2 of sheets 3.

As is understood by the person skilled in the art, the two opposing sides 6*a*, 6*b* of one or more stacks 2 of sheets 3 is when referred to one stack 2 of sheets 3 meant as the opposing sides 6*a*, 6*b* of the one stack 2 of sheets. In the context of a plurality of stacks 2 of sheets 3, the term opposite sides 6*a*, 6*b* refers to the outer edges of two distinct stacks 2. For instance, if three stacks 2*a-c* of sheets 3 are arranged side by side in a row, the opposite side refer to the outer sides of the first 2*a* and second 2*b* end stacks. The first end stack 2*a*, positioned at one end of the row, has its outer side facing away from any adjacent stack. Similarly, the second end stack 2*b*, situated at the opposite end of the row, also has its outer side facing away from adjacent stacks. The third stack 2*c* is positioned in the middle of the row, between the first 2*a* and the second 2*b* stack.

The two side clamping devices 22 have planar surfaces 23 configured to face and interact with said one or more stacks 2 of sheets 3. The planar surfaces 23 extends along a normal direction to the support surface 10. This allows the two side clamping devices 22 to interact with stacks 2 of sheets 3 of different heights. The planar surfaces 23 provide a consistent interaction with the stack 2 of sheets 3, which may maintain the integrity of the stack 2 and prevent errors or damage during handling.

In FIG. 2 the arrangement 1 is provided with one top clamping device 30. The top clamping device 30 is configured to exert a downward pressure onto said one or more stacks 2 of sheets 3. The top clamping device 30 can be moved in and out of contact with the stack 2 of sheets and as can be seen in FIG. 2 none of the side clamping devices 22 and the top clamping device 30 are in contact with the stack 2 of sheets 3. In this context, moved in and out of contact involves a movement along the normal direction to the support surface. The top clamping device 30 may, in all embodiments, be a vacuum top clamping device, i.e., a top clamping device 30 having a vacuum or under-pressure functionality allowing it to apply an under-pressure to the top sheets of the stack 2.

In FIG. 3 the arrangement 1 is interacting with one stack 2 of sheets 3. As can be seen, only the two side clamping devices 22 are used in this example to interact with the stack 2 of sheets 3. The two side clamping devices 22 have a great functionality when there is one stack 2 of sheets 3. By clamping the stack 2 of sheets 3 between the two side clamping devices 22, the stack 2 of sheets 3 can easily be maneuvered over the support surface 10. The maneuver unit 20 together with the supplied gas through the openings 12 in the support surface 10 allows the stack 2 of sheets 3 to slide smoothly over the support surface 10.

The two side clamping devices 22 are in this embodiment independently moveable along the longitudinal direction L in relation to the maneuver unit 20. This allows the two side clamping devices 22 to operate individually with the stack 2 of sheets 3. By moving one of the two side clamping devices 22, the stack 2 of sheets 3 may be moved towards the second of the two side clamping devices 22. This movement could also be combined with the top clamping device 30 providing a downward pressure to keep the stack 2 of sheets 3 in order. Further, the top clamping device 30 may be moveable along the longitudinal direction L in relation to the two side clamping devices 22. This allows the top clamping device 30 to be moved and positioned at a desired position above the stacks 2 of sheets 3. This allows the arrangement to operate with bigger variety of stack sizes. It also allows the top clamping device 30 to aid in moving or holding the respective stack of sheets.

Furthermore, the at least one top clamping device 30 may also be used to put a pressure on the one or more stacks 2 of sheets 3 during a cutting process. By putting pressure on the one or more stacks 2 of sheets 3 a more precise cut may be achieved as the sheets 3 are not able to move during the cut.

In FIG. 4 the arrangement 1 is interacting with three different stacks 2 of sheets 3. If only the two side clamping devices 22 would be used in this case, there may be a mixture of the stacks 2 of sheets 3 or any other type of unorder between the stacks 2 of sheets 3 may occur. To avoid this problem, two top clamping devices 30 is provided. The top clamping devices 30 may be used to put a downward pressure on for example two stacks 2 of sheets 3 each such that the two stacks 2 of sheets 3 are not able to move toward each other, thereby mixture of the two stacks 2 of sheets 3 can be avoided. The top clamping devices 30 can extend over both of the stacks 2 of sheets 3 such that both stacks 2 of sheets 3 are pressed by one top clamping device 30. It should be noted that one top clamping device 30 could be used for more than two stacks 2 of sheets 3 and also for one stack 2 of sheets 3 as well.

When having two or more top clamping devices 30 these could be independently moveable along the longitudinal direction L in relation to each other. This may allow the at least two top clamping devices 30 to adapt to different sizes of stacks 2 of sheets 3 and to adapt to how the stacks 2 of sheets 3 are distributed. As an example, if there are two stacks 2 of sheets 3, the two top clamping devices 30 may be moved to apply a downward pressure on one each of the two stacks 2. However, if there are three or four stacks 2 of sheets 3, the two top clamping devices 30 may be moved to apply a downward pressure on two stacks 2 each.

To facilitate the movement of the stacks 2 of sheets 3 over the support surface 10 while the top clamping devices 30 exert a downward pressure on the stacks 2 of sheets 3, the gas supplied through the openings 12 may be supplied at a pressure being balanced in relation to the downward pressure from the top clamping device 30. This forms a gas cushion 13 underneath the stacks 2 of sheets 3.

By forming the gas cushion 13 underneath the stacks 2 of sheets 3 the order in the stack 2 of sheets 3 may be more easily kept. With balance between the force from the gas applied through the openings 12 and the downward pressure from the top clamping device 30, the stack 2 of sheets 3 will be clamped between the gas cushion 13 and the top clamping device 30. In other words, the stack 2 of sheets 3 could be seen as being in a hovering state above the support surface 10 while still being pushed together by the gas cushion 13 and the top clamping device 30. The gas cushion 13 underneath the one or more stacks 2 of sheets 3 will both assist with clamping the one or more stacks 2 of sheets 3 and facilitate the movement of the one or more stacks 2 of sheets 3 over the support surface 10, due to the hovering state of the one or more stacks 2 of sheets 3.

The gas cushion 13 is formed by supplying gas at a pressure through the openings 12 in the support surface 10. By having a plurality of openings 10, the gas can counteract the downwards pressure from the top clamping device 30. This counteracting force can be adapted based on the denseness of the openings 12 and at what pressure the gas is provided. How the openings 12 may be distributed over the support surface 10 depend on what type of stacks of sheets that are handled. For example, a stack of sheets of a heavier material may require a higher density of openings 12 and/or that the gas is provided at a higher pressure than a stack 2 of sheets 3 of a lighter material.

As can be understood from FIGS. 3 and 4, the side clamping devices 22 and the at least one top clamping device 30 allow for using different combinations of clamping to maneuver the stack 2 of sheets 3. For example, with only one of the side clamping devices 22, the stack 2 of sheets 3 can be pushed over the support surface 10. By using both of the side clamping devices 22, the stack 2 of sheets 3 can be clamped and maneuvered around on the table and be rotated. The top clamping device 30 can alone be used to clamp the stack 2 of sheets 3 or stacks 2 of sheets 3 to move and rotate these. Further, a combination of the side clamping devices 22 and the top clamping device 30 can be used to move a plurality of stacks 2 of sheets 3. to achieve these combinations, the two side clamping devices 22 and said at least one top clamping device 30 are at least partly independently maneuverable thereby allowing the arrangement to maneuver one stack 2 of sheets 3 and also to maneuver a plurality of stacks 2 of sheets 3 arranged in a row one after the other along the longitudinal direction L between the two side devices 22. In other words, with the provided arrangement 1 it is not only possible to handle one stack 2 of sheets 3 at a time, but also to handle a plurality of stacks 2 of sheets 3 at the same time.

Additionally, variations to the disclosed embodiments can be understood and effected by the skilled person in practicing the claimed invention, from a study of the drawings, the disclosure, and the appended claims. In the claims, the word "comprising" does not exclude other elements or steps, and the indefinite article "a" or "an" does not exclude a plurality. The mere fact that certain measures are recited in mutually different dependent claims does not indicate that a combination of these measured cannot be used to advantage.

The invention claimed is:

1. An arrangement for handling one stack of sheets and also handling a plurality of stacks of sheets, the arrangement comprising;

a support surface being arranged to support one or more stacks of sheets and being provided with a plurality of openings for supplying a gas underneath said one or more stacks of sheets, a maneuver unit being moveable relative to the support surface and comprising two side clamping devices, the two side clamping devices being arranged at a distance from each other along a longitudinal direction and being configured to interact with two opposing sides of said one or more stacks of sheets, and at least one top clamping device configured to exert a downward pressure onto said one or more stacks of sheets, wherein the two side clamping devices and said at least one top clamping device are independently maneuverable in relation to each other thereby allowing the arrangement to maneuver one stack of sheets and also to maneuver a plurality of stacks of sheets arranged in a row one after the other along the longitudinal direction between the two side clamping devices.

2. The arrangement according to claim 1, wherein said at least one top clamping device includes a vacuum functionality.

3. The arrangement according to claim 1, wherein the two side clamping devices are independently moveable along the longitudinal direction in relation to the maneuver unit.

4. The arrangement according to claim 1, wherein the gas is supplied at a pressure being balanced in relation to the downward pressure from said at least one top clamping device such that there is formed a gas cushion underneath said one or more stacks of sheets.

5. The arrangement according to claim 1, comprising at least two top clamping devices.

6. The arrangement according to claim 5, wherein said at least two top clamping devices are independently moveable along the longitudinal direction in relation to each other.

7. The arrangement according to claim 1, wherein the maneuver unit is translationally and rotationally moveable in a plane parallel to a plane defined by the support surface.

8. The arrangement according to claim 1, wherein the maneuver unit is supported by one or more robot arms.

9. The arrangement according to claim 1, wherein the two side clamping devices have planar surfaces configured to face and interact with said one or more stacks of sheets, thereby allowing the two side clamping devices to interact with stacks of sheets of different heights.

10. The arrangement according to claim 1, wherein said at least one top clamping device is moveable along the longitudinal direction in relation to the two side clamping devices.

11. The arrangement according to claim 1, wherein the gas supplied through the plurality of openings and the downward pressure from said at least one top clamping device are balanced to provide said one or more stacks of sheets are in a hovering state above the support surface while being clamped between a gas cushion formed by the gas and said at least one top clamping device.

12. The arrangement according to claim 1, wherein said at least one top clamping device extends over and exerts downward pressure onto at least two stacks of sheets simultaneously.

13. The arrangement according to claim 1, wherein the arrangement is configured to position said one or more stacks of sheets for cutting by a cutting machine.

14. The arrangement according to claim 1, wherein the two side clamping devices comprise planar surfaces that extend along a normal direction to the support surface.

15. The arrangement according to claim 1, wherein said at least one top clamping device is moveable in and out of contact with said one or more stacks of sheets along a direction normal to the support surface.

* * * * *